United States Patent [19]

Aranow Rosalind B.

[11] Patent Number: 4,723,300

[45] Date of Patent: Feb. 2, 1988

[54] CONVERTIBLE TOTE BAG

[76] Inventor: Aranow Rosalind B., 725 S. 4th St., Philadelphia, Pa. 19147

[21] Appl. No.: 921,033

[22] Filed: Oct. 20, 1986

[51] Int. Cl.[4] ..... A45C 9/00; A45C 4/06

[52] U.S. Cl. ..... 383/4; 190/1; 5/420

[58] Field of Search ..... 5/417, 418, 419, 420; 190/1, 2; 383/4

[56] References Cited

U.S. PATENT DOCUMENTS

| | | | |
|---|---|---|---|
| 1,553,697 | 9/1925 | Lederer | 383/4 X |
| 1,604,658 | 10/1926 | Post | 5/417 X |
| 1,930,942 | 10/1933 | Pringle | 383/4 X |
| 3,041,638 | 7/1962 | Vico | 5/419 |
| 3,489,194 | 1/1970 | Hoover | 5/420 X |
| 4,154,323 | 5/1979 | Sneider | 383/4 X |
| 4,566,130 | 1/1986 | Coates | 383/4 X |
| 4,631,765 | 12/1986 | Casey | 5/417 |

FOREIGN PATENT DOCUMENTS

| | | | |
|---|---|---|---|
| 1264919 | 2/1972 | United Kingdom | 383/4 |
| 2061712 | 5/1981 | United Kingdom | 190/2 |

*Primary Examiner*—William Price

*Attorney, Agent, or Firm*—Caesar, Rivise, Bernstein, Cohen & Pokotilow, Ltd.

[57] ABSTRACT

A convertible tote bag for holding articles therein. The bag includes a front and rear panel which are connected together along their side edges by a pair of zippers. When the zippers are unzipped, the panels can be folded flat, thereby exposing a moisture absorbing pad on which a baby can be placed for diapering. The moisture absorbent pad is releasably secured to the panels. Interposed between the pad and the panels is a releasably secured moisture impervious barrier layer to protect the panels from being wet or soiled. The barrier layer and the pad can be readily removed to enable each to be cleaned. The bag also inlcudes a pair of carrying handles and at least one exterior pocket.

13 Claims, 3 Drawing Figures

CONVERTIBLE TOTE BAG

BACKGROUND OF THE INVENTION

This invention relates generally to devices for carrying items and more particularly to "tote" type bags which are convertible.

Various tote bags are on the market and arranged for carrying various articles such as infant diapering accessories. Moreover, some such tote bags are convertible to enable the bag to be opened or laid flat to provide a diaper changing surface for the infant. Thus, such convertible tote bags include releasable securement means, such as zippers or Velcro fasteners to enable the bag to be converted into a pad-like changing surface. While such convertible tote bags may be generally suitable for their intended purpose, they nevertheless leave much to be desired from the standpoint of ease of use, comfort to the infant, resistance to soiling or wetting and the ability to be readily cleaned.

OBJECTS OF THE INVENTION

Accordingly, it is a general object of the instant invention to provide a convertible tote bag which overcomes the deficiencies of the prior art.

It is a further object of the instant invention to provide a convertible tote bag which is simple in construction.

It is still a further object of this invention to provide a convertible tote bag which include means for serving as a baby diapering surface which can be readily removed from the tote bag to enable it to be cleaned.

It is still a further object of the instant invention to provide a convertible tote bag having moisture impervious barrier means to prevent the tote bag from being wet or soiled when the diaper of an infant is changed thereon.

It is still a further object of this invention to provide a convertible tote bag having at least one closeable auxiliary compartment in addition to a main compartment for storing or carrying articles therein.

SUMMARY OF THE INVENTION

These and other objects of the invention are achieved by providing a convertible bag for holding articles therein and arranged to be opened to provide a clean and soft surface for diapering an infant thereon. The bag comprises front and rear panels. Each panel is formed of a flexible material and includes a pair of side edges, a top edge and a bottom edge. The panels are connected together along their bottom edge and are also releasably secured to each other along their side edges via respective releasable securement means, extending continuously therealong. When the panels are secured together along their side edges, they form a hollow chamber for holding the articles. Handle means are connected to at least one of the panels. Each of the panels has an inside surface. A moisture impervious, barrier is releasably secured to the inside surface of the panels and a pad formed of a soft and absorbent material is disposed over the barrier and releasably secured to the panels and the barrier. The side edges of the panels are arranged to be disconnected from each other to enable the panels to be laid flat on a surface, with the inside surfaces thereof facing upward so that an infant can be placed on the pad for diapering, with the barrier means protecting the inside surface of the panels from being soiled. The pad and the barrier means are removable to enable each to be cleaned when desired.

Other objects and many of the attendant advantages of this invention will be readily appreciated as the same becomes better understood by reference to the following detailed description when considered in conjunction with the accompanying drawing wherein:

DESCRIPTION OF THE PREFERRED EMBODIMENT

Figure 1:
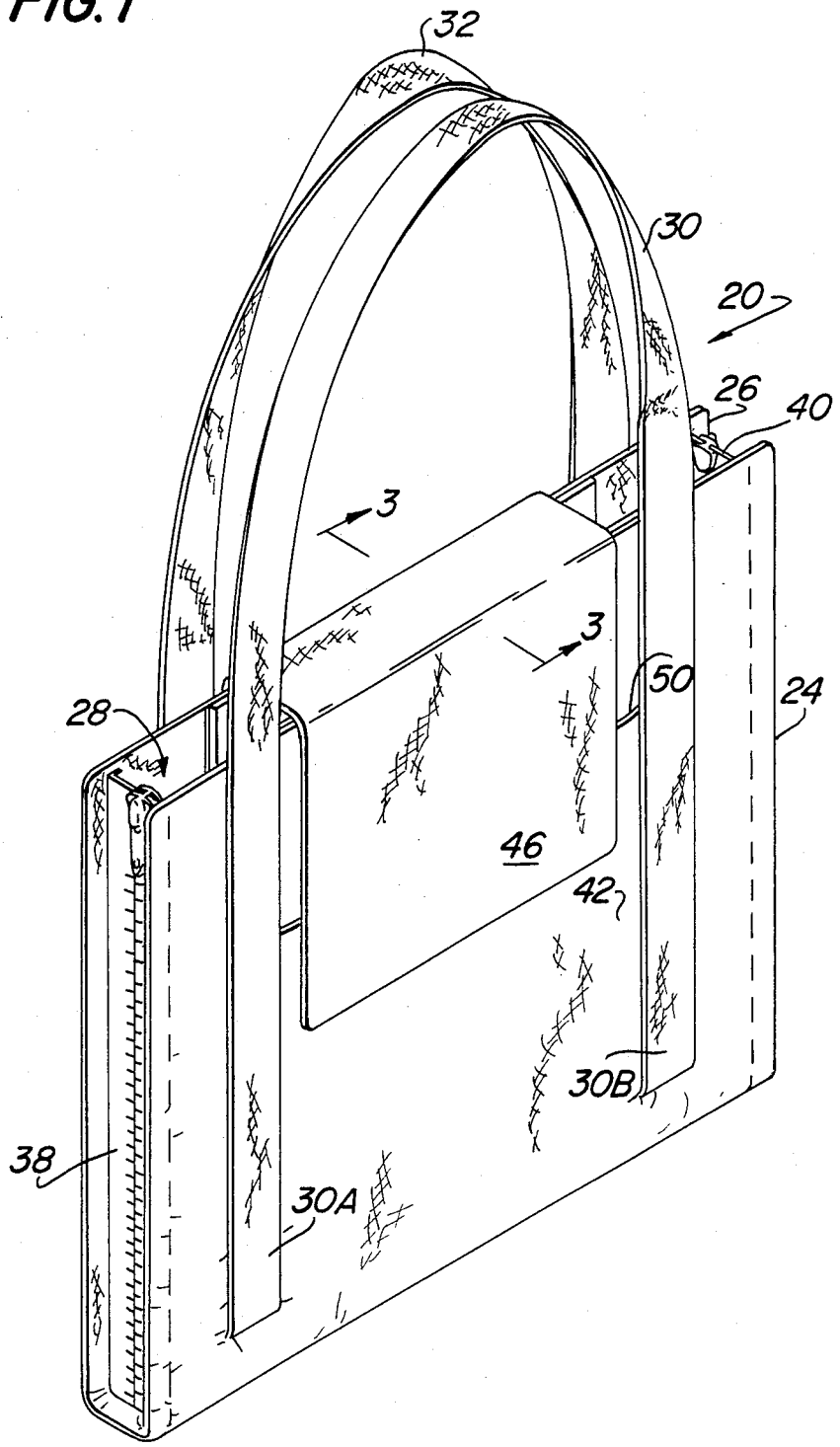
FIG. 1 is a perspective view of a convertible tote bag constructed in accordance with this invention and showing the bag in its closed condition.
Figure 2:
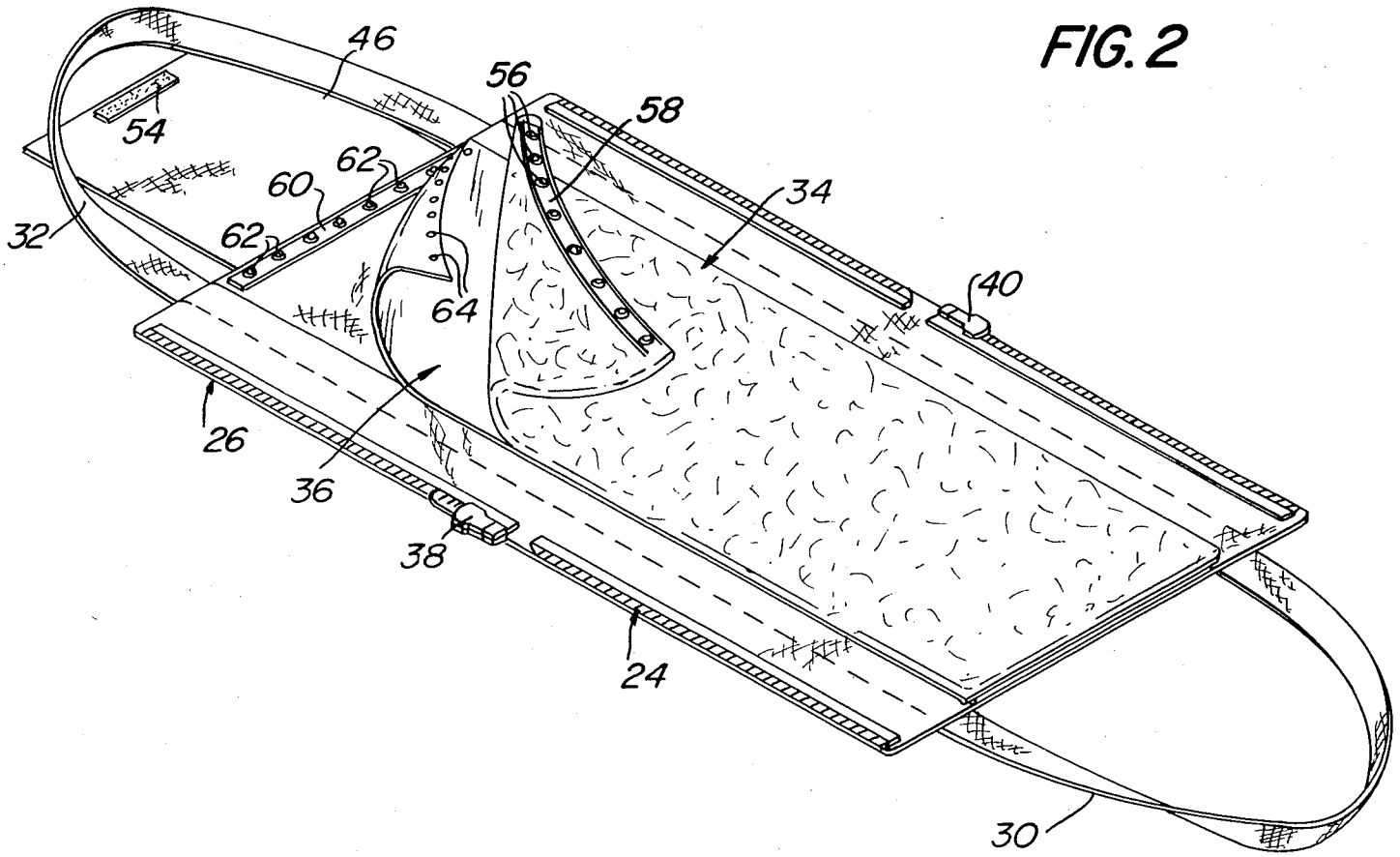
FIG. 2 is a perspective view of the convertible tote bag shown in FIG. 1 but in its open or laid flat position wherein it is arranged to be used to serve as a diapering surface for an infant.

Referring now in greater detail to the various figures of the drawing wherein like references characters refer to like parts, there is shown generally at 20 in FIG. 1 a convertible tote bag constructed in accordance with the subject invention. The bag 20 is formed of a pair of flexible panels 24 and 26 which are arranged to be secured together by zippers, to be described later, to form an article holding interior chamber 28. The bag also includes a pair of handles 30 and 32 secured to the panels 24 and 26, respectively. The bag 20 is arranged to be opened (unzipped) and laid flat, as shown in FIG. 2 to expose a pad 34 located within the chamber 28. Located under the pad means 34 is a moisture impervious barrier 36. The details of the pad and barrier means will be described later. Suffice for now to state that the pad serves to provide a soft and absorbent surface for diapering a baby thereon while the underlying barrier serves to provide a moisture impervious shield to protect the panels of the bag from being wet or soiled during the diaper changing procedure.

Figure 3:
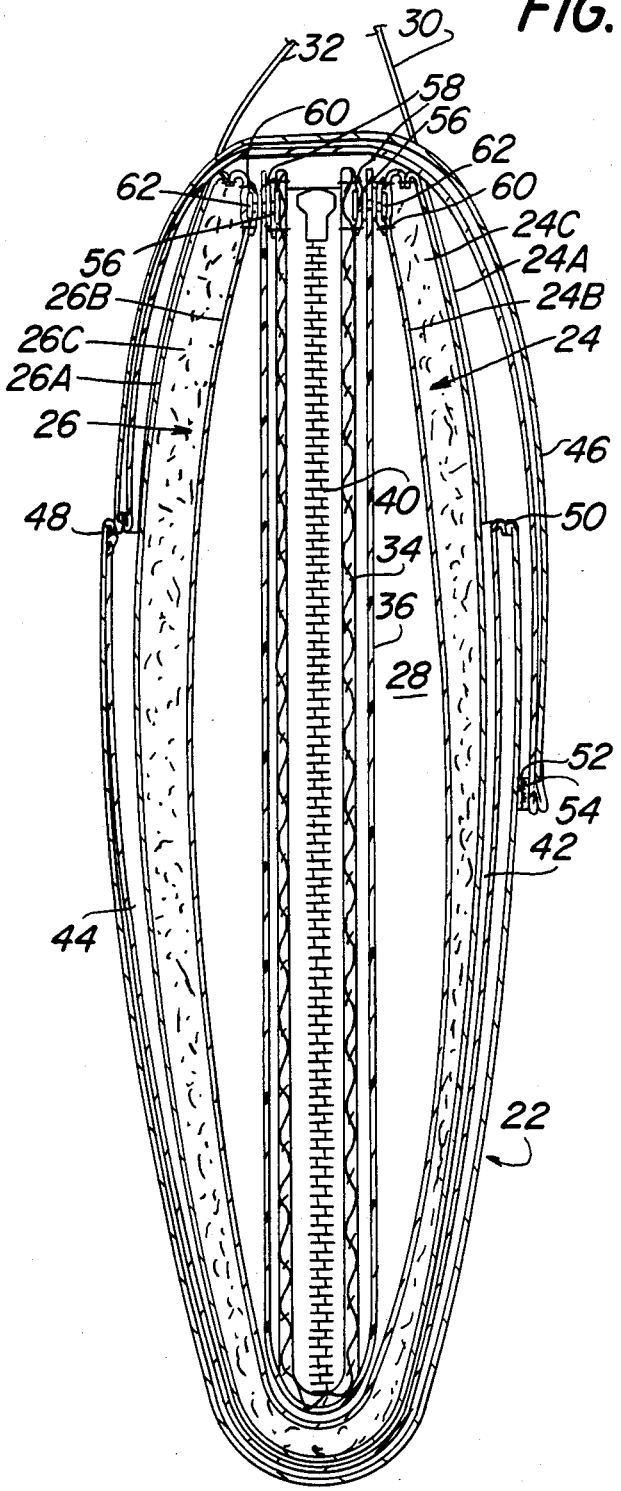
FIG. 3 is an enlarged sectional view taken along line 3—3 of FIG. 1.

As can be seen in FIG. 1, the front panel 24 and the rear panel 26, are each generally planar members of rectangular shape. In accordance with the preferred embodiment and in the interest of providing a soft support for the baby when he/she is disposed on the pad, as will be described later, the front and rear panels are each formed of a tripartite, padded construction. Thus, as can be seen in FIG. 3, the front panel 24 includes an outer fabric 24A, an inner fabric layer 24B and a padding layer 24C interposed therebetween. The rear panel 26 is similarly constructed of an outer fabric layer 26A, inner fabric layer 26B and an interposed padding layer 26C. The front and rear panels are permanently secured together along the bottom edge of the bag. In fact, in the preferred embodiment, as seen in FIG. 3, the front and rear panel are formed as an integral unit, that is, outer layer 24A and outer layer 26A are formed as a single fabric layer while inner layers 24B and 26B are formed as a single fabric layer. The fabric forming the outer and inner layers can be any suitable material, such as polyester, nylon, dacron, etc., while the padding can also be any suitable fluffy material, such as dacron fiber fill.

Each of the panels 24 and 26 also includes an opposed pair of side edges. One side edge of the front panel 24 is releasably secured to the corresponding side edge of the rear panel 26 via a first conventional, fully separatable zipper 38, while the opposite side edge of the front panel 24 is releasably secured to the opposite side edge of the rear panel 26 by a second similar zipper 40. The zippers extend for the full length of each of the side edges so that when they are zipped up, the front and rear panel form a baglike construction having the heretofore mentioned chamber 28 therein. The chamber is suitable for holding many types of articles, such as baby powder, diapers, cleaning lotions, etc., therein.

In order to provide additional space for carrying articles in the bag 20, its front panel includes a pocket 42 while its rear panel includes another pocket 44. As can be seen in FIG. 3, both pockets are also formed by two layers of a fabric which are stitched together to form a double thickness wall. One double thickness wall is sewn onto the front panels 24 and the other double thickness wall is stitched onto the rear panel 26.

In order to close off the top of the tote bag compartment 28 and the two pockets 42 and 44, a flap 46 is provided on the bag. The flap 46 like the pockets 42 and 44 is formed of two layers of fabric which are sewn together. The flap 46 is secured, i.e., sewn, to the top edge 48 of the rear wall pocket 44. The flap is flexible and extends over the upper edges of the front and rear panels and over the lip 50 of the front panel pocket 42 for releasable securement thereto. To that end, one component strip 52 of a two compartment releasable fastening system, such as Velcro®, is secured onto the outer wall of the pocket 42. A cooperating strip 54 of Velcro® is secured to the inner wall of the flap 46 adjacent the free end thereof. Thus, when the flap 46 is folded over the top of the tote bag 20 as shown in FIG. 3, the two component strips 52 and 54 engage each other to hold the flap 46 in place, thereby closing off the pockets 44 and 42 as well as the interior or chamber 28 of the bag 20.

In order to carry the bag, it includes the heretofore identified handles 30 and 32. As shown in FIG. 1, each of the handles 30 and 32 comprises a strap or narrow web of fabric of generally U-shape and having a pair of ends, each of which is fixedly secured, i.e., sewn, to the associated panel of the bag 20. Thus, end portions 30A and 30B of handle 30 are sewn to the front panel 24, whereas the corresponding end portions (not shown) of handle 32 are sewn to the rear panel 26 in the same manner.

When the zippers 38 and 40 are fully unzipped and separated and the flap 46 disconnected from the front of the pocket 42 by separating the two Velcro® strips 52 and 54, the bag can be laid flat, that is, the two panels 24 and 26 can be pivoted outward from each other and laid flat on a surface, like shown in FIG. 2. This action exposes the pad 34 so that it can be used as a changing surface for the diapering or cleaning of an infant (not shown).

As can be seen in FIG. 2, the pad 34 is an elongated rectangular web of a soft, and moisture absorbent fabric, such as terrycloth. The pad 34 is releasably secured to the two panels 24 and 26 via releasable fastening means. In this regard, as can be seen clearly in FIG. 2, the underside surface of the pad 34 along each of its end includes a plurality of conventional female snap elements 56 mounted on a strip 58. Each strip 58 is fixedly secured, such as by being sewn, to the underside of the pad 34 along its respective edge. Once strip 60 of plural male snap elements 62 is fixedly secured, such as by being sewn, along the top edge of the inside surface of panel 26 and another and identical strip 60 is similarly secured along the top edge of the inside surface of panel 24. The snap elements on strips 60 cooperaate with the snap elements on strips 58 so that the pad 34 can be snapped into place on the inside surface of the panels 24 and 26.

In order to protect the fabric forming the inside surface of the panels 24 and 26 from being soiled or wet, the heretofore identified barrier means 36 is provided. That means basically comprises a web of a flexible moisture impervious, e.g., plastic, material which is coextensive in size with the pad 34. The web 36 includes a plurality of apertures 64 equadistantly spaced along its two ends. The spacing of the apertures 64 is such as to accommodate the spacing of male snap element 62 of the strips 60 so that the pad 34 can be snapped in place on the inner surface of the two panels 24 and 26 with the plastic barrier web interposed therebetween and held in place against accidental disconnection.

By virtue of the releasable securement of the pad 34 and the barrier web 36 to the panel members 24 and 26, the tote bag 20 can be readily cleaned. Thus, all that is required to clean the bag 20 is to remove its pad 34 by undoing its snaps. The pad can be washed or otherwise cleaned. The barrier web can also be removed so that it can be washed, wiped off or otherwise cleaned. Once the pad and barrier have been cleaned, they can then be reconnected to the inner surface of the two panels 24 and 26.

In order to convert the device 20 back to its tote bag configuration, all that is required is to fold the two panels 24 and 26 along their bottom edge and thereafter zip up the two zippers 38 and 40. The bag is now ready to hold various articles therein. Once the articles are placed therein, the flap 46 can be folded over the opened upper end of the tote and brought down into engagement with the Velcro® fastening means on the front of the front pocket to close off the compartments.

It must be pointed out at this juncture that the tote 20 need not be constructed as shown herein. Thus, the front and rear panels can be of alternative shapes and various releasable fastenings can be used for the two zippers 38 and 40 and for the snaps 56 and 62. Moreover, other materials can be used to make up the panel, the absorbent pad and the moisture impervious barrier web.

Without further elaboration, the foregoing will so fully illutrate my invention that others may, by applying current or future knowledge, readily adopt the same for use under various conditions of service.

What is claimed is:

1. A convertible bag for holding articles therein and arranged to be opened to provide a clean and soft surface for diapering an infant thereon, said bag comprising a front and rear panel, each formed of a flexible material and having a pair of side edges, a top edge and a bottom edge, said panels being connected to each other along said bottom edge, said panels also being secured to each other along said side edges via respective releasable securement means extending continuously along said side edges, whereupon when said panels are secured together along their side edges, they form a hollow chamber for said articles, handle means connected to at least one of said panels, each of said panels having an inside surface, moisture impervious barrier means in the form of a web of flexible plastic material having a top edge and a bottom edge and releasably secured to said inside surface by releasable securement means located adjacent said top and bottom edges, and a pad formed of a web of soft and absorbent material having a top edge and a bottom edge and being disposed over said barrier means and releasably secured by releasable securement means located adjacent said top and bottom edges to said panels, said side edges of said panels being arranged to be disconnected from each other to enable said panels to be laid flat on a surface with said inside surface thereof facing upward to thereby expose said pad, with said barrier means already located thereunder and held flat by said releasable securement means, said releasable securement means also holding said pad flat when said panels are laid flat, whereupon a baby can be placed on said pad for diapering and with said barrier means protecting the inside surface of said panels from soiling, said pad and said barrier means being separately removable to enable each to be cleaned, when desired.

2. The convertible bag of claim 1 wherein said panels are connected to each other along their sides via zipper means extending therealong.

3. The bag of claim 2 wherein said pad is releasably secured to said panels via snap fastener means.

4. The bag of claim 1 wherein said releasable securement means comprise plural snap fasteners and wherein said web of plastic material includes a plurality of apertures therein through which said snap fasteners extend.

5. The bag of claim 4 wherein said pad is formed of terrycloth material.

6. The bag of claim 5 wherein said side edges of said panels are releasably secured together via zipper means extending along the length thereof.

7. The bag of claim 6 wherein said bag comprises handle means.

8. The bag of claim 1 wherein said panels each include an outside surface, and wherein a pocket is provided in at least one of said outside surfaces for holding articles therein.

9. The bag of claim 1 wherein at least one of said panels includes flap means connected thereto and arranged to be extended over said top edges of said panels and into engagement with the other of said panels when said side edges are secured together to close off the interior of said bag.

10. The bag of claim 8 wherein at least one of said panels includes flap means connected thereto and arranged to be extended over said top edges of said panels and into engagement with the other of said panels when said side edges are secured together to close off the interior of said bag.

11. The bag of claim 10 wherein said flap means also closes off said pocket.

12. The bag of claim 1 wherein said bag is formed of a fabric.

13. The bag of claim 12 wherein said fabric is padded.

* * * * *